US005338118A

United States Patent [19]

DeMatteis

[11] Patent Number: 5,338,118

[45] Date of Patent: Aug. 16, 1994

[54] PLASTIC BAGS AND HANDLE CONSTRUCTION FOR PLASTIC BAGS

[76] Inventor: Robert B. DeMatteis, 800 E. Washington, Colton, Calif. 92324

[21] Appl. No.: 4,743

[22] Filed: Jan. 14, 1993

[51] Int. Cl.[5] ..... B65D 33/08

[52] U.S. Cl. ..... 383/10; 383/17

[58] Field of Search ..... 383/7, 8, 10, 17, 903; 229/68 C, 87.04, DIG. 6

[56] References Cited

U.S. PATENT DOCUMENTS

| | | | |
|---|---|---|---|
| 2,679,351 | 5/1954 | Soffa | 383/10 |
| 4,401,427 | 8/1982 | Benoit et al. . | |
| 4,759,639 | 7/1988 | DeMatteis . | |
| 4,811,418 | 3/1989 | Reifenhauser . | |
| 4,846,587 | 7/1989 | Hull | 383/10 |
| 4,911,561 | 3/1990 | Wagner . | |

FOREIGN PATENT DOCUMENTS

| | | | |
|---|---|---|---|
| 0466094 | 6/1950 | Canada | 383/10 |
| 1433433 | 6/1966 | France . | |
| 312570 | 5/1929 | United Kingdom | 229/68 C |

*Primary Examiner*—Allan N. Shoap
*Assistant Examiner*—Jes F. Pascua
*Attorney, Agent, or Firm*—Darby & Darby

[57] ABSTRACT

A plastic bag having an aperture serving as a handle which has a contour of peaks and valleys. The peaks fold in an accordion-like manner when pressed by fingers to cushion the fingers. A T-shirt style bag has strap handles whose juncture with the mouth of the bag has a wave form configuration of peaks and valleys. A dispensing rack having two support arms which hold open a plastic bag either by notches, bends or sleeves. The plastic bag has opposing pairs of aligned apertures whose contour has peaks and valleys. The support arms are inserted each through are respective pair of aligned apertures.

7 Claims, 3 Drawing Sheets

PLASTIC BAGS AND HANDLE CONSTRUCTION FOR PLASTIC BAGS

BACKGROUND OF THE INVENTION

1. Field of the Invention

The present invention relates to plastic bags, an aperture handle construction for thermoplastic films and plastic bags, and a dispensing rack.

2. Discussion of Related Art

Thin-gauge thermoplastic films and plastic bags are known to have apertures which serve as handles and to have apertures used for suspending the films or bags on racks. The racks generally have two arms extending parallel to each other for supporting a stack of the bags for dispensing them one at a time. T-shirt style bags are also known to have strap handles extending upwardly from opposite sides of the mouth.

An aperture handle may be die-cut and configured to be grasped for carrying the bag. The two most common conventional handle designs are round and oval. Round handle apertures generally have stronger strength characteristics but are usually not very comfortable to carry. Handle comfort can be improved by making bags with a heavier film gauge, or by increasing the film thickness in the handle region. This is the case in "thick-thin" versions of plastic bags in which the upper strip of bag material is a thicker gauge than the body in order to improve handle comfort. Handle apertures of an oval configuration have a top portion which is a straight horizontal edge that typically cuts right into the carrier's hand, causing discomfort for the carrier. Comfort for this handle style can be improved by attaching a plastic patch directly inside the bag wall prior to the handle die-cut operation, hence doubling up the material and improving the handle padding.

SUMMARY OF THE INVENTION

One aspect of the present invention is directed to an aperture handle in a bag whose contour is configured to have a series of peaks and valleys. Such a contour promotes a more uniform distribution of stresses across its periphery when grasped.

Further, such a contour provides a more comfortable feel on the fingers than would otherwise be the case if the fingers pressed against a curved edge of the aperture directly, because the peaks create an accordion-like bunching up of the plastic material under force of the fingers pressing against the peaks. Such bunching up creates a cushioning effect against the fingers as if it were padding. This effect increases the comfort level for holding the thin-gauged plastic bags at the aperture.

BRIEF DESCRIPTION OF THE DRAWINGS

For a better understanding of the present invention, reference is made to the following description and accompanying drawings, while the scope of the invention is set forth in the appended claims.

DESCRIPTION OF THE PREFERRED EMBODIMENT

Figure 1:
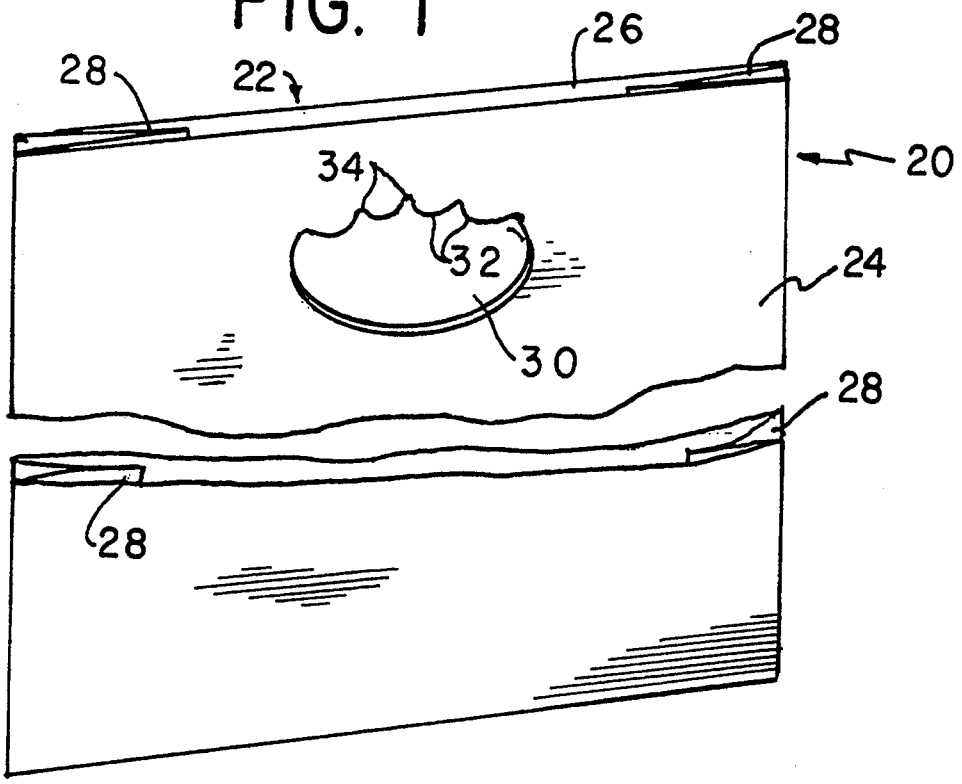
FIG. 1 is a perspective view of a plastic bag with aperture handle in accordance with the invention.

FIG. 1 shows a plastic bag 20 in accordance with the invention. The bag has an opening 22 between front 24, back 26 and folded side gusset 28 portions. An aperture 30, which functions as a handle (an "aperture handle") extends through the front portion 24 and is aligned with an identical aperture handle that extends through the back portion 26. Each aperture is generally oval except along the upper portion as shown in FIGS. 1–4. This top portion has a contour in the form of a series of peaks 32 and valleys 34, as may result from cutting the aperture handle with a punch die cut.

Figure 2:
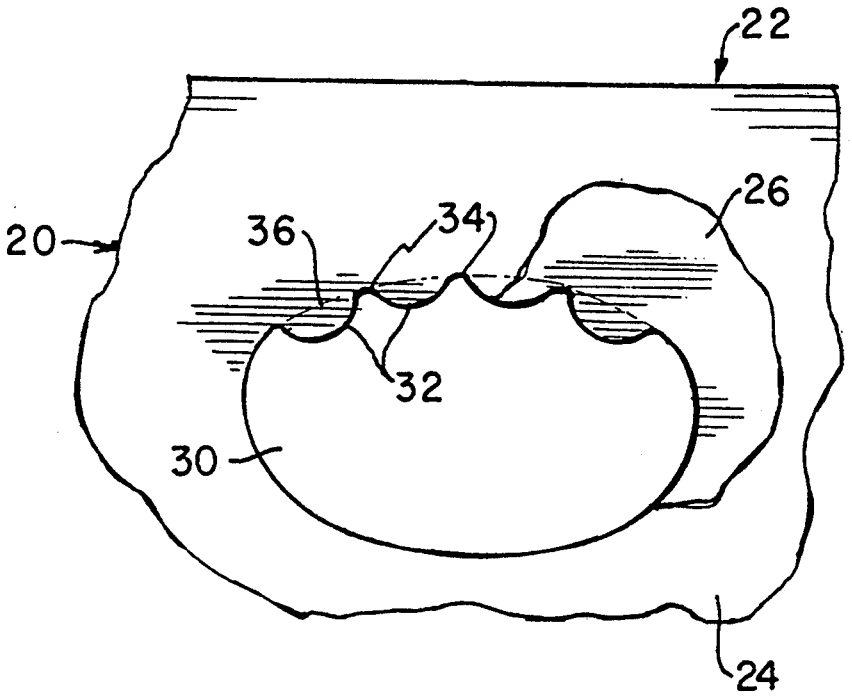
FIG. 2 is a partially broken front view of the plastic bag of FIG. 1 in the vicinity of the aperture handle.
Figure 3:
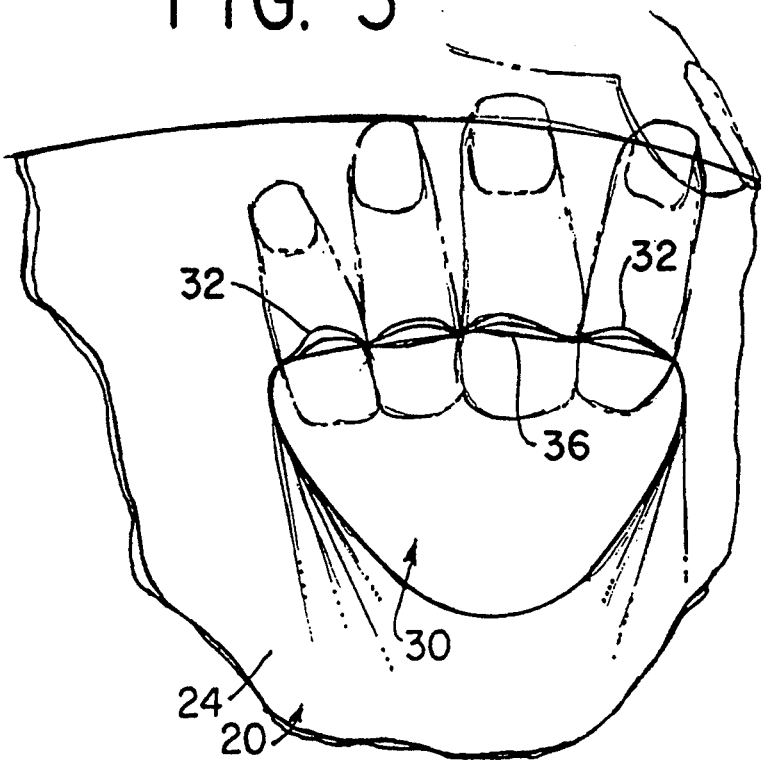
FIG. 3 is a front view as in FIG. 2 but also showing the handle being held by a person's hand.
Figure 4:
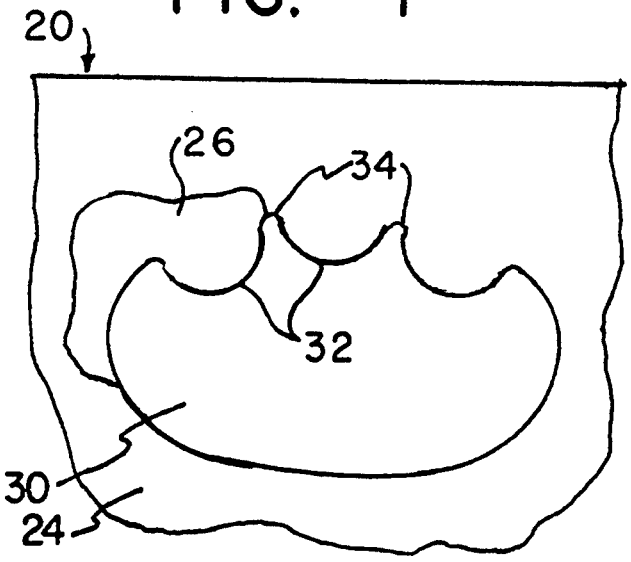
FIGS. 4, 4*a* and 4*b* are each a partially broken front view as in FIG. 2 but for respective further embodiments of the aperture handle.

The aperture handle embodiment of FIGS. 1–3 includes four peaks 32 and five valleys 34, while the embodiment of FIG. 4 includes three peaks 32 and four valleys 34. Smaller size bags may have the aperture handle of FIG. 4 while larger size bags may have the aperture handle of FIGS. 1–3. Similarly, a smaller handle may have the peaks and valleys extend into side areas of its contour. Thus, in response to a larger hand being inserted into the smaller hole, these side areas adjust upwardly atop the fingers.

FIG. 3 illustrates that the peaks 32 are arranged to allow a user's fingers to press against them when a bag contains a load and is being carried. The fingers compress the peaks to fold in an accordion-like manner which bunches them up and provides a cushioning or padding effect. Thus, carrying the bag by grasping the handle as in FIG. 3 reduces the concentrated stress on the fingers that would otherwise be present without this cushioning or padding effect. As a result, the bag becomes more comfortable to carry than it would if the fingers pressed directly against a sharp curved or straight edge at the top of the aperture handle, which would tend to dig into the fingers when carrying heavy loads.

As seen in FIG. 3, the material comprising the peaks 32 compress under pressure below a base line 36, which generally follows an imaginary curve line passing through each of the valleys 34. The peaks bunch up or flatten substantially at the level of this base line. Peaks extending by as little as 1/8 inch provide noticeable improvement in the carrying comfort even on a thin film as compared to a handle with no peaks. The bags of FIGS. 1–4 may be low density plastic bags as well as thinner high density bags.

Figure 4A:
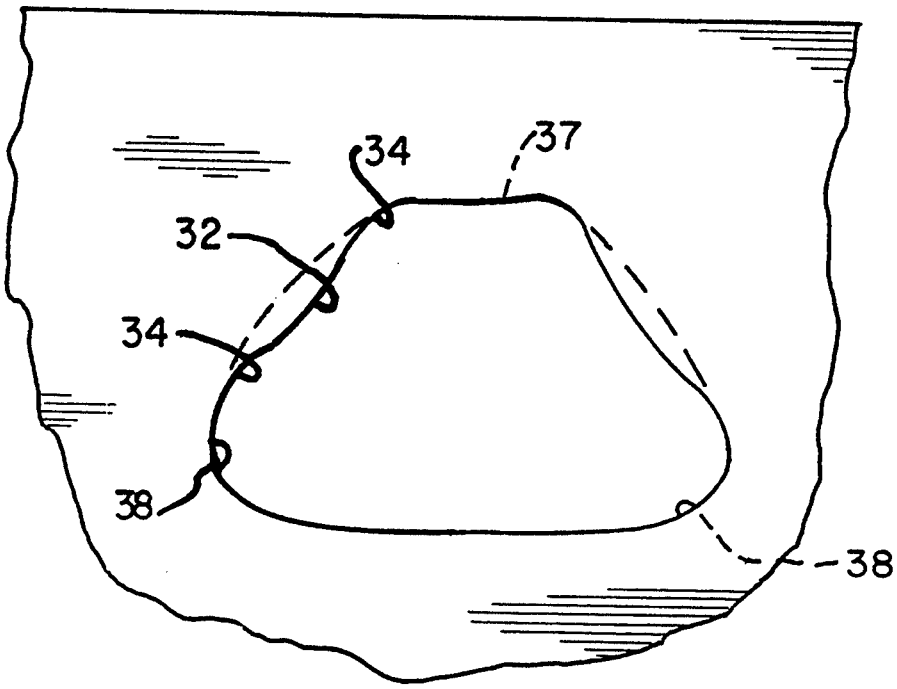

FIG. 4*a* shows a further embodiment in which the aperture handle has two lower curved portions 38 which mirror each other, a valley 34 adjacent thereto, an inwardly extending flap or peak 32, another valley 34, and a top portion 37, which extends in a substantially horizontal direction. The peak and valleys mirror those on the other side. When grasped, the peaks bunch up, cushioning the grasping fingers, and so does the top portion 37. The bags may be 0.0005 to 0.001 gauge high density bags and may accommodate a relatively large handle aperture.

Figure 4B:
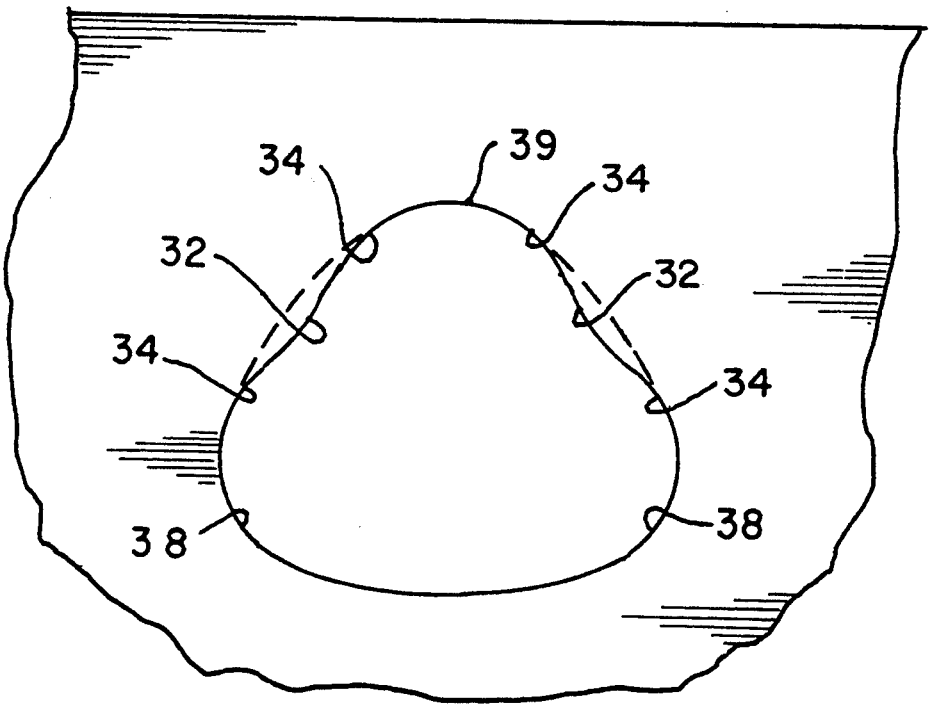

FIG. 4*b* is similar to FIG. 4*a* except that instead of the top portion extending in a substantially horizontal direction, it defines a curve 39. This curve will not dig into the grasping fingers if the aperture is held such that the peaks bunch up or compress. For the embodiment of FIG. 4*b*, the bags may be 0.00045 to 0.00075 gauge high density bags and may accommodate a relative narrower handle aperture.

In both the FIGS. 4*a* and 4*b* embodiments, the peaks have greater stress concentration than does the top portion, yet the cushioning by the flaps or peaks 32 helps to distribute the stress and makes grasping the handle more comfortable. The embodiments of FIGS. 1–4*b* also may be used for low and high density patch handle plastic bags. The patch serves as a reinforcement at the aperture handle. Conventionally, the patch is not soft, but rather sharp and my cut into a carrier's hand. When applied to such patch handle plastic bags, the embodiments of FIGS. 1–4*b* improve the softness of the patch handle. In addition, the embodiments of FIGS. 1–4*b* will also improve the softness of a thick-thin bag's handle.

While the foregoing description and drawings represent the preferred embodiments of the present invention, it will be understood that various changes and modifications may be made without departing from the spirit and scope of the present invention.

What is claimed is:

1. A plastic bag including opposing apertures serving as handles for the bag, said apertures each having means for cushioning the fingers when grasped, said cushioning means comprising a contour of said apertures which includes a plurality of peaks and valleys arranged so that two of said peaks space apart at least three of said valleys, said peaks being means configured to compress and fold under manual force applied by fingers when said handles are grasped while the bag carries a load that exerts a force oppositely directed to that of said manual force, said peaks which are compressed and folded cushioning the fingers with respect to a stress line that forms adjacent each of the handles due to the force applied by the load said stress line defining a curve along which said inner valley lies between said two outer valleys.

2. A bag as in claim 1, wherein said apertures have areas of concentrated stress at opposite sides when the bag is held by grasping the bag at the apertures, said peaks and valleys extending across said areas of concentrated stress.

3. A bag as in claim 1, wherein each of the peaks fold when subjected to respective manual finger pressure caused by pressing against the peaks when grasping the bag at the contour of the aperture, the peaks when so folded creating a cushion effect for cushioning the fingers.

4. A bag as in claim 1, wherein the peaks and valleys resemble a scalloped wave pattern.

5. A bag as in claim 1, wherein the apertures have two lower curved portions mirroring each other, a top portion, and two flaps each extending inwardly between said top portion and a respective one of said curved portions, said flaps constituting said peaks each being between two valleys, each of said flaps folding in response to finger pressure when grasped by fingers for cushioning the fingers.

6. A bag as in claim 5, wherein the top portion bunches up in response to finger pressure to provide cushioning.

7. A bag as in claim 1, wherein an outer two of said valleys are at an elevation which is lower than that of an inner one of said three valleys when the handles are so grasped.

* * * * *